US007538645B2

(12) United States Patent
Nishi et al.

(10) Patent No.: US 7,538,645 B2
(45) Date of Patent: May 26, 2009

(54) ELECTROMAGNETIC RELAY

(75) Inventors: Yasuhisa Nishi, Miyagi (JP); Hiromitsu Ito, Miyagi (JP)

(73) Assignee: NEC Tokin Corporation, Miyagi (JP)

( * ) Notice: Subject to any disclaimer, the term of this patent is extended or adjusted under 35 U.S.C. 154(b) by 42 days.

(21) Appl. No.: 11/668,738

(22) Filed: Jan. 30, 2007

(65) Prior Publication Data

US 2008/0180198 A1 Jul. 31, 2008

(51) Int. Cl.
*H01H 51/22* (2006.01)
*H01H 9/04* (2006.01)

(52) U.S. Cl. ..... 335/78; 335/202; 200/306

(58) Field of Classification Search ..... 335/78–86, 335/202, 278; 200/306
See application file for complete search history.

(56) References Cited

U.S. PATENT DOCUMENTS 4,427,863 A 1/1984 Fujita ..... 200/306
5,289,144 A * 2/1994 Liao ..... 335/78

FOREIGN PATENT DOCUMENTS

EP 0986290 A2 3/2000
EP 1 026 716 A1 9/2000
EP 1 091 236 A2 11/2001
GB 2 029 107 A 3/1980
JP 5-242784 9/1993
JP 11-145667 5/1999

OTHER PUBLICATIONS

European Search Report which was issued by the European Patent Office in relation to corresponding European Patent Application on Jun. 29, 2007, pp. 1 to 6.

* cited by examiner

*Primary Examiner*—Ramon M Barrera
(74) *Attorney, Agent, or Firm*—Whitham Curtis Christofferson & Cook, P.C.

(57) ABSTRACT

An electromagnetic relay is provided which enables a coating process with a coating agent even after being mounted on a printed circuit board having undergone reflow heating by preventing invasion of water while maintaining air permeability. A main body making up the electromagnetic relay includes an electrical contact portion, electromagnetic driving portion and molded resin base and is covered with the molded resin cover. One or more through holes are formed by applying laser beam from a rear side of the molded resin cover. A spot diameter of each through hole on a surface of an outside of the molded resin cover is 0.1 μm to 10 μm. Instead of the molded resin cover, through-holes each having a size of 0.1 μm to 10 μm may be formed by applying the laser beam to the molded resin base. Moreover, a liquid crystal polymer may be used as the molded resin cover or base having a filtering function, by forming holes to pass through only skin layers making up the liquid crystal polymer by applying the laser beam to the liquid crystal polymer.

8 Claims, 6 Drawing Sheets

ELECTROMAGNETIC RELAY

BACKGROUND OF THE INVENTION

1. Field of the Invention

The present invention relates to an electromagnetic relay and more particularly to the electromagnetic relay that can be suitably used as vehicle-mounted electrical components.

2. Description of the Related Art

A conventional electromagnetic relay having a switching function by opening and closing of electrical contacts and being used widely and commonly as a vehicle-mounted component includes electrical contacts and a molded resin material in which a molded resin base and an electromagnetic driving portion formed on the molded resin base are covered with a molded resin cover and is sealed with a thermosetting sealing resin. In the case where the electromagnetic relay is fully hermetically sealed from the outside, an escape path for air formed inside the relay is shut and, therefore, hermeticity occurs readily due to a thermal stress caused by reflow heating especially at an interface between a metal and a resin each having a different thermal expansion coefficient or in a bonding portion between a molded resin and a sealing resin. In the electromagnetic relay in which hermeticity has occurred, water, solvent, or a like invade from the outside, which causes an operational failure and a contacting failure of contact portions.

FIG. 6 is an exploded perspective view of a conventional electromagnetic relay. FIGS. 7A and 7B are cross-sectional views explaining a structure of a conventional molded resin cover of FIGS. 6A and 6B, and FIG. 7A is a vertical sectional view of a conventional unsealed-type of a through hole and FIG. 7B is a vertical sectional view of a conventional sealed-type through-hole. In the conventional electromagnetic relay, as shown in FIGS. 6A and 6B, an electromagnetic relay main body 3 assembled on a molded resin base 4 is covered with a molded resin cover 1 and is sealed with a sealing resin 5 and through-holes 2 are formed on a top surface of the molded resin cover 1. Conventionally, two types of the through-holes 2, one is an unsealed type of the through-hole in which an unsealed-type portion 2*a* shown in FIG. 7A is not shut while a sealed-type portion 2*b* shown in FIG. 7B is shut by fusing a top portion of the through-hole 2 and using a thermal caulking process at its top portion so that the electromagnetic relay is hermetically sealed.

If it is assumed that there is heat-stress caused by reflow heating on the electromagnetic relay, the above unsealed-type through-holes 2 (2*a*) are mainly used. However, in the case of the through-holes 2 formed on the top of the molded resin cover 1, since conditions for shapes and diameters are to be satisfied by considering moldability and workability of thermal caulking and since its aperture portion is wide, there is a risk that all kinds of substances on an outside of the electromagnetic relay invade easily into the electromagnetic relay. In particular, when the electromagnetic relay is used as a vehicle-mounted component by performing the reflow heating, in some cases, a coating agent is applied to all surfaces of the electromagnetic relay after being mounted on a printed circuit board and, in this case, the application of the coating agent to the through-holes 2 should be avoided. If the through-holes 2 are shut by the coating agent, the coating agent invades inside of the electromagnetic relay in some cases, causes an operational failure and/or contacting failure at contact portions. Moreover, a whole cleaning method in which the electromagnetic relay together with the printed circuit board are soaked should be also avoided. Thus, the unsealed through-holes 2 (2*a*) which do not provide a sealed state have a remarkably high risk and a limitation is imposed on the execution of unsealing method.

Conventional technology discloses a method of increasing hermeticity in the electromagnetic relay in which the conventional sealing resin 5 is replaced with a new sealing resin 5 having high heat-resistance and a bonding characteristic being higher than those of the conventional molded resin cover 1 and molded resin base 4 as shown in FIGS. 6A and 6B.

To solve the above problems, conventional technology is disclosed in Patent Reference 1 (Japanese Patent Application Laid-open No. Hei 5-242784) in which a filter having tiny and porous air holes is used. Another similar technology is disclosed in Patent Reference 2 (Japanese Patent Application Laid-open No. Hei 11-145667) in which polymerized monomers are applied which form air holes by adding radiation of an electromagnetic wave, ultraviolet rays, or a like.

The above-disclosed technology to increase heat-resistance and/or bonding characteristic of the sealing resin 5 are not sufficient to provide methods of improving bonding strength that can satisfy all conditions for diverse reflow heating. There is a limit point at which pressure inside the electromagnetic relay becomes high due to a high temperature and hermeticity failure occurs due to excessive thermal expansion. Therefore, cases are assumed where any one of the diverse conditions for the reflow heating exceeds the limit point at which hermeticity failure occurs. Moreover, the sealing resin 5 is vulnerable to changes by a coating condition, thermosetting condition, circumferential conditions such as an ambient temperature, humidity or the like and, therefore, its bonding characteristic is easy to change and it is impossible to keep its bonding strength constant in the manufacturing processes. As a result, the limit point causing the hermeticity failure changes.

Each of the technology to apply porous filters (the Patent Reference 1) and the technology to apply polymerized monomers to form air holes has problems (Patent Reference 2) in that it is difficult to establish the method of the applications. Moreover, the heat stress in the reflow heating causes it difficult to keep the air holes constantly porous. Additionally, new problems of an increase of component counts, increased costs caused by the increase of component counts, and increased number of man-hours arise.

SUMMARY OF THE INVENTION

In view of the above, it is an object of the present invention to provide an electromagnetic relay which is capable of preventing an operational failure and a contacting failure at contact portions by maintaining air permeability and resistance to water (water invasion preventing property) even after being heated at a high temperature and by avoiding invasion of a coating agent. That is, the object of the present invention is to provide the electromagnetic relay which enables application of the coating agent even after being mounted on printed circuit boards having undergone reflow heating and water cleaning without causing an increase in component counts while maintaining air permeability and preventing the invasion of water.

According to a first aspect of the present invention, there is provided an electromagnetic relay including:

a main body including an electrical contact portion, an electromagnetic driving portion, and a molded resin base for mounting the electrical contact portion and the electromagnetic driving portion; wherein the main body is covered with a molded resin cover and is sealed with a sealing resin and wherein one or more through-holes are formed by applying laser beam to desired positions of the molded resin cover from an inner surface side thereof so that the through-holes each are within a size range in which no invasion of water from the outer side into the inner side thereof occurs and in which air permeability of the molded resin cover can be maintained through the through-holes.

In a forgoing first aspect, a preferable mode is one wherein the through-holes each are set within spot diameter of 0.1 μm to 10 μm on an outer surface side of the molded resin cover as the size range.

According to a second aspect of the present invention, there is provided an electromagnetic relay including:

a main body including an electrical contact portion, an electromagnetic driving portion, and a molded resin base for mounting the electrical contact portion and the electromagnetic driving portion; wherein the main body is covered with a molded resin cover and is sealed with a sealing resin and wherein one or more through-holes are formed by applying laser beam to desired positions of the molded resin base from an inner surface side thereof, the desired positions which are not covered with the sealing resin on an outer surface side thereof so that the through-holes each are within a size range in which no invasion of water from the outer side into the inner side thereof occurs and in which air permeability of the molded resin base can be maintained through the through-holes.

In a foregoing second aspect, a preferable mode is one the through-holes each are set within spot diameter of 0.1 μm to 10 μm on an outer surface side of the molded resin base as the size range.

According to a third aspect of the present invention, there is provided an electromagnetic relay including:

a main body including an electrical contact portion, an electromagnetic driving portion, and a molded resin base for mounting the electrical contact portion and the electromagnetic driving portion; wherein the main body is covered with a molded resin cover and is sealed with a sealing resin and wherein the molded resin cover comprises a liquid crystal polymer having skin layers with identical orientation formed on both sides of a core layer in an intermediate position between the skin layers and wherein laser beams are applied to desired positions of the molded resin cover from both inner and outer sides thereof so that the laser beam passes through only the skin layers with the core layer being left unprocessed by the laser beams to form one or more through-holes on each of the skin layers which each are within a size range in which no invasion of water from the outer side into the inner side thereof occurs and in which air permeability of the molded resin cover can be maintained through the through-holes.

In a foregoing third aspect, a preferable mode is one the through-holes each are set within spot diameter of 0.1 μm to 10 μm on an outer surface side of the molded resin cover as the size range.

According to a fourth aspect of the present invention, there is provided an electromagnetic relay including:

a main body including an electrical contact portion, an electromagnetic driving portion, and a molded resin base for mounting the electrical contact portion and the electromagnetic driving portion; wherein the main body is covered with a molded resin cover and is sealed with a sealing resin and wherein the molded resin cover comprises a liquid crystal polymer having skin layers with identical orientation formed on both sides of a core layer in an intermediate position between the skin layers and wherein laser beams are applied to desired positions of the molded resin base from both inner and outer sides thereof, the desired positions which are not covered with the sealing resin on an outer surface side thereof, so that the laser beams pass through only the skin layers with the core layer being left unprocessed by the laser beams to form one or more through-holes on each of the skin layers which each are within a size range in which no invasion of water from the outer side into the inner side thereof occurs and in which air permeability of the molded resin base can be maintained through the through-holes.

In a foregoing fourth aspect, a preferable mode is one the through-holes each are set within spot diameter of 0.1 μm to 10 μm on an outer surface side of the molded resin base as the size range.

With the above configuration, it is made possible to provide the electromagnetic relay having both air permeability and resistance to water, which enables the coating process with the coating agent even after being mounted on the printed circuit board having undergone reflow heating and also which enables a water-cleaning process, thereby eliminating an operational failure and contacting failure at contact portions. That is, the electromagnetic relay of the present invention has a method of forming stable air ventilating openings (air holes) on the molded resin even after being heated at high temperature, which ensures only high air permeability and resistance to water (water invasion preventing property) of the electromagnetic relay. The size of each of the air ventilating openings is fine and its shape and dimension can be fully controlled and, as a result, it is possible to achieve high resistance to water while controlling air permeability. Additionally, it is made possible to avoid invasion of the coating agent, thereby preventing the operational failure and contacting failure at contact portions.

BRIEF DESCRIPTION OF THE DRAWINGS

The above and other objects, advantages, and features of the present invention will be more apparent from the following description taken in conjunction with the accompanying drawings in which:

FIG. 1A is a perspective view of a molded resin cover with an aperture portion faced upward and FIG. 1B is an expanded diagram showing portions where laser beam irradiation was performed;

FIG. 3A is a perspective view of a molded resin base on which a main body of the electromagnetic relay is mounted and FIG. 3B is an expanded perspective view of a portion in which laser beam was applied;

FIG. 6A is an exploded perspective view of the conventional electromagnetic relay and FIG. 6B is a partially cutaway perspective view showing the conventional electromagnetic relay; FIG. 7A is a vertical sectional view of a conventional unsealed-type of a through hole and FIG. 7B is a vertical sectional view of a conventional sealed-type through-hole.

DETAILED DESCRIPTION OF THE PREFERRED EMBODIMENTS

Best modes of carrying out the present invention will be described in further detail using various embodiments with reference to the accompanying drawings. According to embodiments of the present invention, when air ventilating openings are formed by laser beam irradiation, a diameter of each air ventilating opening falls within a range of 0.1 μm to 10 μm. The diameter of each air ventilating opening is a size of an exit portion through which laser beam passes on a surface of a molded resin making up the electromagnetic relay. The size of the laser-beam irradiating portion is changed to calibrate a diameter of the exit portion that allows laser beam to pass through. The size of each hole of 0.1 μm to 10 μm is a size range in which no invasion of water into an inside of the electromagnetic relay occurs and in which air permeability can be maintained when water is in contact with the surface of the molded resin and when a water contact angle to the molded resin to be used for the electromagnetic relays is taken into consideration in general. Moreover, resistance to water can be adjusted within the above size range.

Any one of excimer laser, $CO_2$ laser, or YAG laser may be applied to the above processing. In some cases, a through-hole cannot be formed by one-time laser beam irradiation depending on a thickness of the molded resin. In this case, the through-hole can be formed by applying laser beam a plurality of times to the same spot.

First Embodiment

Figure 1A:
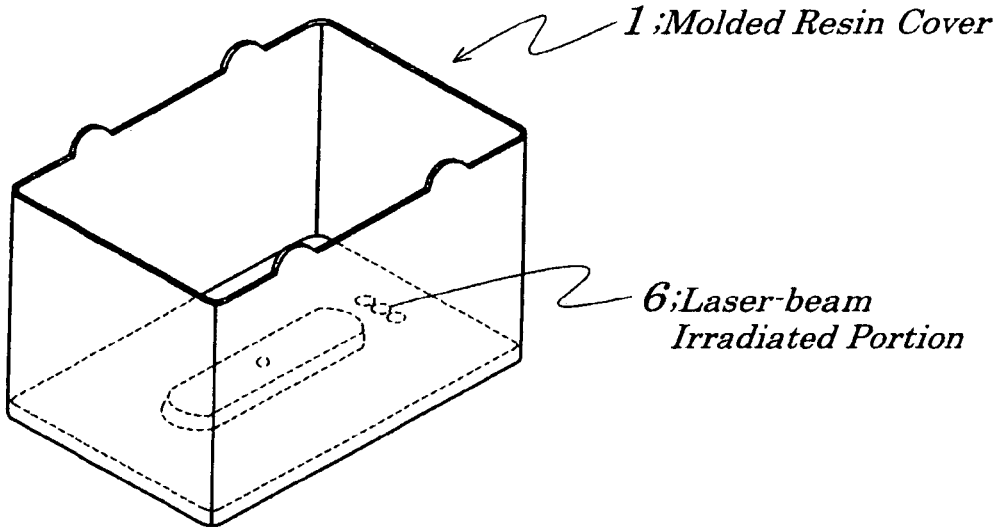
FIGS. 1A and 1B are diagrams showing an electromagnetic relay according to a first embodiment of the present invention.
Figure 1B:
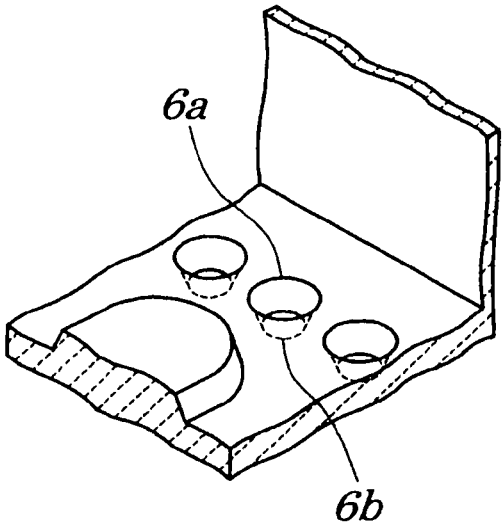
Figure 2:
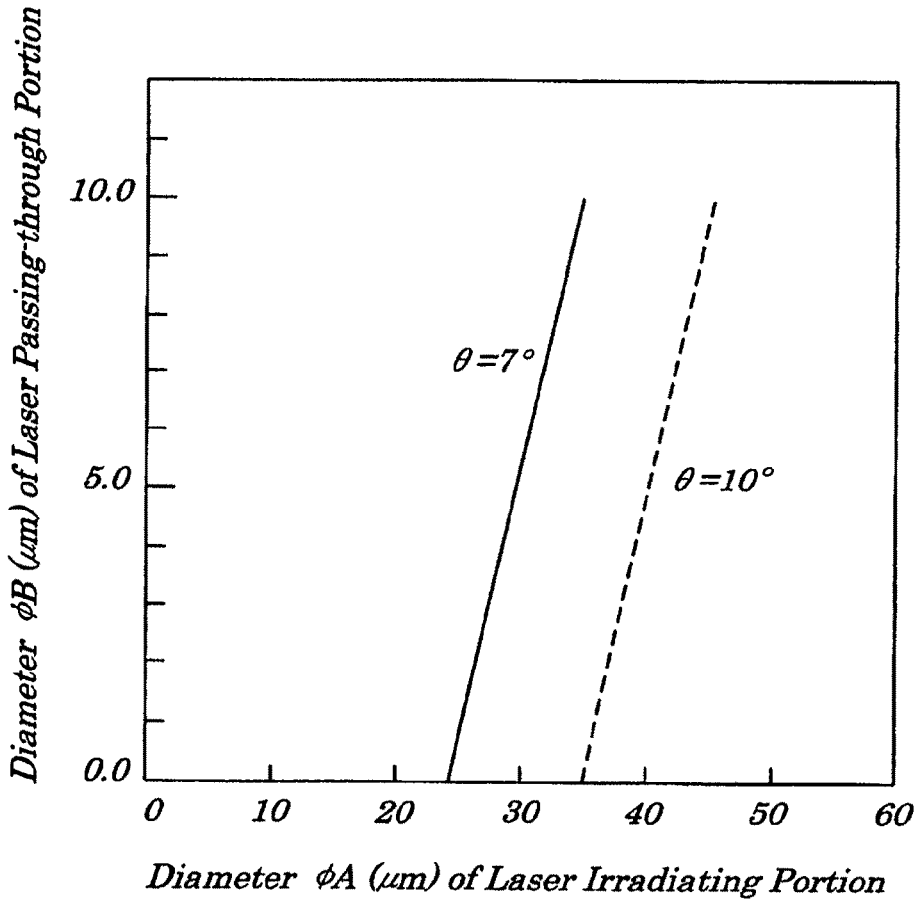
FIG. 2 is a graph illustrating a relation between a diameter ϕA of a laser-beam irradiated portion and a diameter ϕB of a laser beam passing-through portion.
Figure 5:
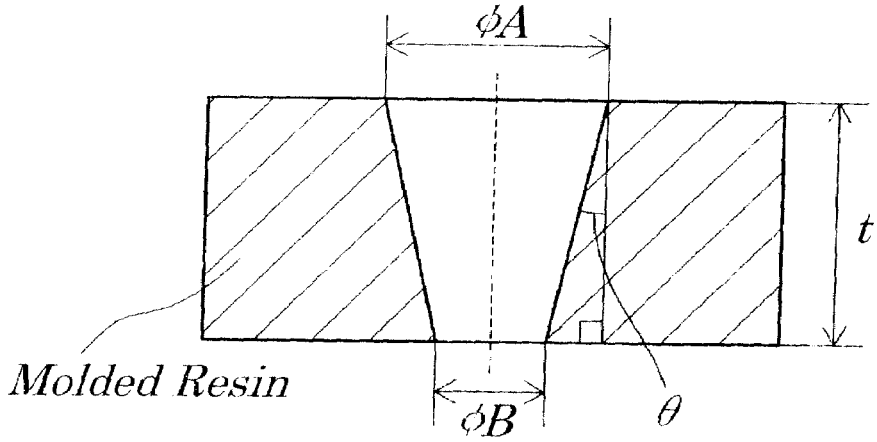
FIG. 5 is a cross-sectional view showing a relation between the diameter ϕA of a laser-beam irradiated portion and the diameter ϕB of a laser beam passing-through portion according to the first embodiment.

FIGS. 1A and 1B are diagrams showing an electromagnetic relay according to a first embodiment of the present invention and FIG. 1A is a perspective view of a molded resin cover 1 with its aperture portion faced upward and FIG. 1B is an expanded diagram showing portions 6 (6*a*, 6*b*) where laser-beam irradiation was performed. In the first embodiment, laser beam is applied surely from an inside of the molded resin cover 1, that is, from a face being opposite to a main body of the electromagnetic relay. Such a technology of applying laser beam is provided by, for example, Shinozaki Manufacturing Co., Ltd (Japan). In an example of forming a shape like this, a relation of a diameter ϕA of the laser-beam irradiated portion 6*a* and a diameter ϕB of the laser-beam irradiated portion 6*b* is shown by an equation $\phi A - 2 \tan\phi \cdot t = \phi B$. FIG. 5 is a cross-sectional view showing a relation between the diameter ϕA of the laser beam irradiated portion (laser beam coming-in side) and the diameter ϕB of the laser beam passing-through portion (laser beam going-out side). In the above equation, "t" denotes a thickness of molded resin and "ϕ" denotes an angle related to focusing of the laser beam. In the case of $CO_2$ laser. $\phi = 7°$ to $10°$. FIG. 2 is a graph showing a relation between the diameter ϕA of the laser-beam irradiated portion 6*a* and the diameter ϕB of the laser beam passing-through portion 6*b*. The thickness "t" is set to be 100 μm. Based on the relation described above, the size ϕB of the laser beam passing-through portion 6*b* is calibrated so as to be equal to an air ventilating opening size of 1 μm to 10 μm.

When a plurality of laser-beam irradiated portions each having a structure shown in FIG. 1B is to be formed, the laser-beam irradiated portions 6*a* are provided with pitches among central points of the irradiated portions each being longer than the diameter ϕA.

By carrying out the first embodiment as above, ventilation is obtained through minute air ventilating openings formed on a surface of the molded resin cover 1. The molded resin cover 1 of the embodiment employs, as its material, resins which have been generally used by known electromagnetic relays. These resins obtained after being molded have a large water contact angle and, therefore, have high resistance to water. Moreover, the employed molded resin cover 1 has high heat resistance and, as a result, even if a reflow heating process is performed under temperature conditions to be applied to lead-less soldering melting or a like, no change in shapes of the processed air ventilating openings occurs due to heat.

Furthermore, regarding a coating agent applicable to the embodiment, it is preferable to select a coating agent having surface wettability to the molded resin cover 1 being equal or less than that of water, that is, having a contact angle of the coating agent to the molded resin cover 1 exceeding a contact angle of water to the molded resin cover 1.

Second Embodiment

Figure 3A:
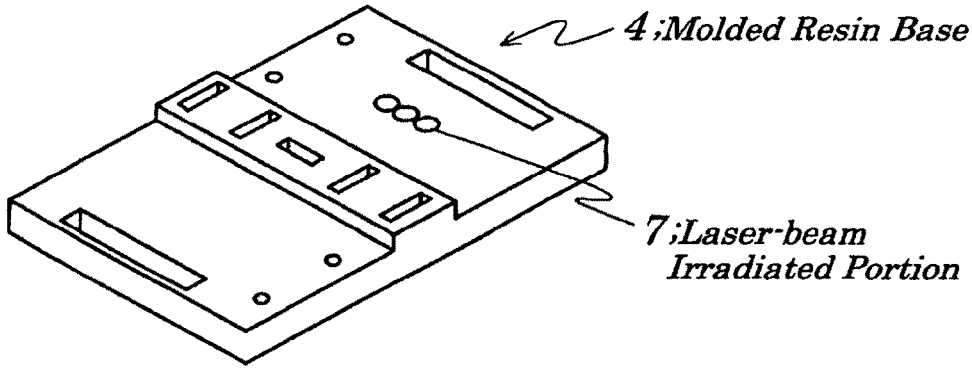
FIGS. 3A and 3B are diagrams illustrating an electromagnetic relay according to a second embodiment of the present invention.
Figure 3B:
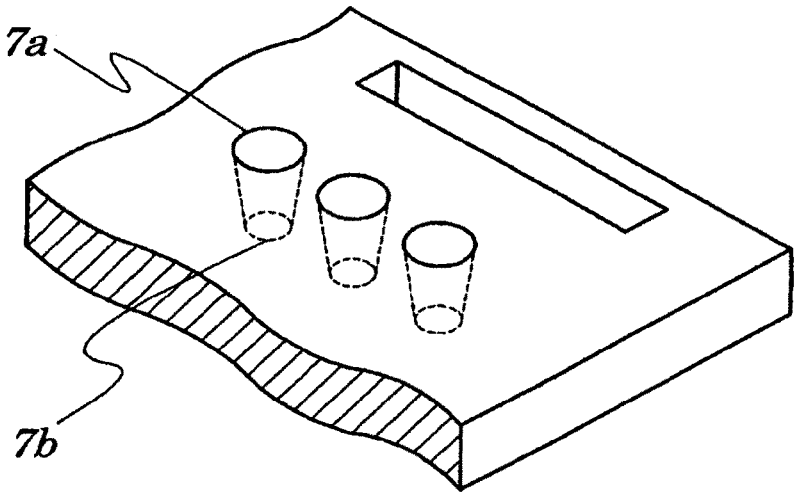

FIGS. 3A and 3B are diagrams illustrating an electromagnetic relay according to a second embodiment of the present invention; and FIG. 3A is a perspective view of a molded resin base 4 on which a main body of the electromagnetic relay is mounted and of portions 7 in which laser beam was applied and FIG. 3B is an expanded perspective view of portions 7 in which laser beam was applied. In the first embodiment, laser beam is applied surely from an inside of a molded resin cover 1. Instead the configuration of the first embodiment, in the second embodiment, one or more through-holes are formed by applying laser beam to desired positions of the molded resin base 4 from an inner surface side thereof, the desired positions which are not covered with a sealing resin 5 on an outer surface side thereof.

When a plurality of laser-beam irradiated portions 7 (7*a*, 7*b*) each having a structure shown in FIG. 3B is to be formed, the laser-beam irradiated portions 7*a* are provided with pitches among central points of the laser-beam irradiated portions each being longer than the diameter ϕA.

By carrying out the second embodiment as shown in FIGS. 3A and 3B, ventilation is obtained through minute air ventilating openings formed on a surface of the molded resin cover 4. The molded resin cover 1 of the embodiment employs, as its material, resins which have been generally used by known electromagnetic relays. These resins obtained after being molded have a large water contact angle, thus providing high resistance to water. Moreover, the employed molded resin base 4 has high heat resistance and, as a result, even if a reflow heating process is performed under temperature conditions to be applied to lead-less soldering melting or a like, no change in shapes of the processed air ventilating openings occurs due to heat.

Furthermore, regarding a coating agent applicable to the second embodiment shown in FIGS. 3A and 3B, it is preferable to select a coating agent having surface wettability to the molded resin cover 1 being equal or less than that of water, that is, having a contact angle of the coating agent to the molded resin base 4 exceeding a contact angle of water to the molded resin base 4.

Third Embodiment

Figure 4:
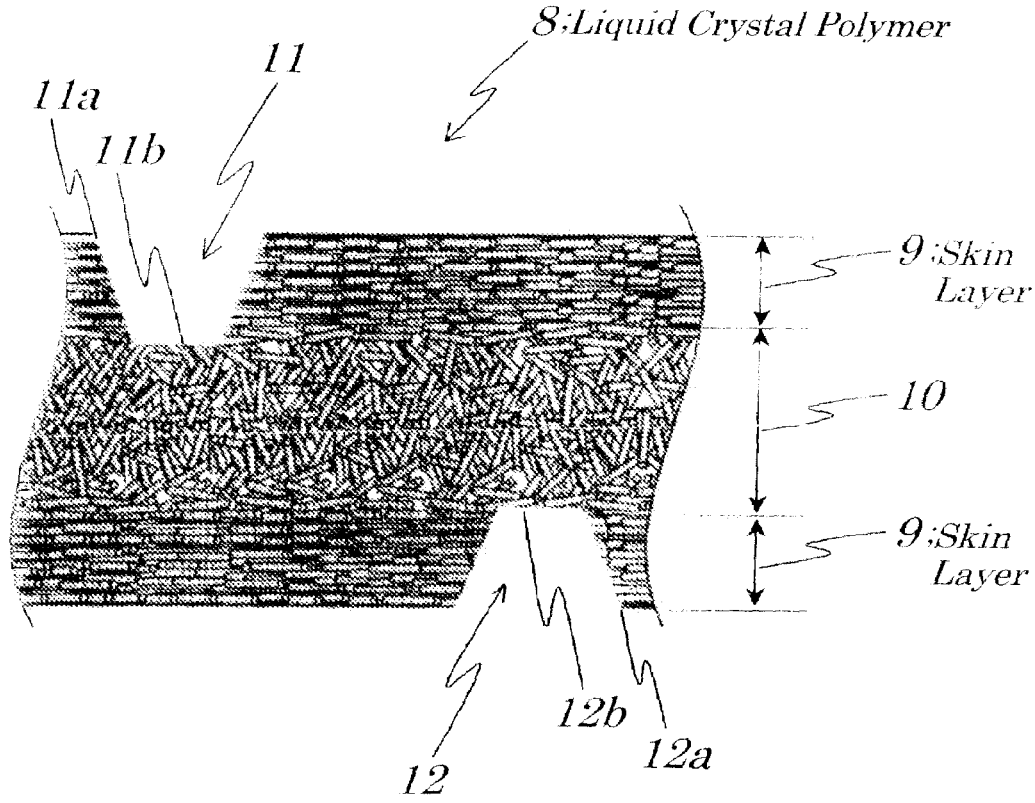
FIG. 4 is an expanded sectional view of a molded resin cover applied to an electromagnetic relay according to a third embodiment.
Figure 6A:
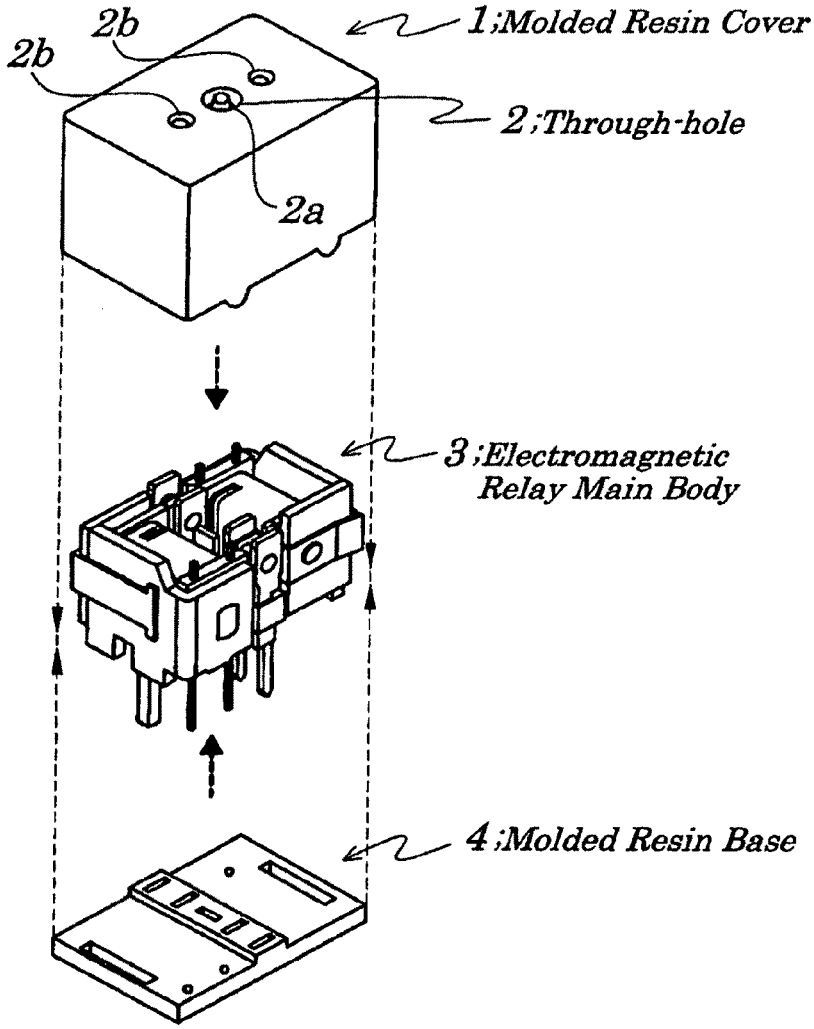
FIG. 6A (RELATED ART)
FIGS. 6A and 6B are perspective views showing a conventional electromagnetic relay.
Figure 6B:
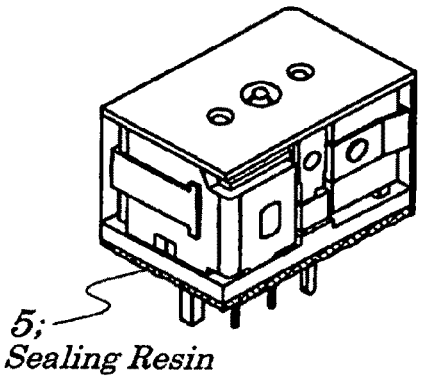
FIG. 6B (RELATED ART)
Figure 7A:
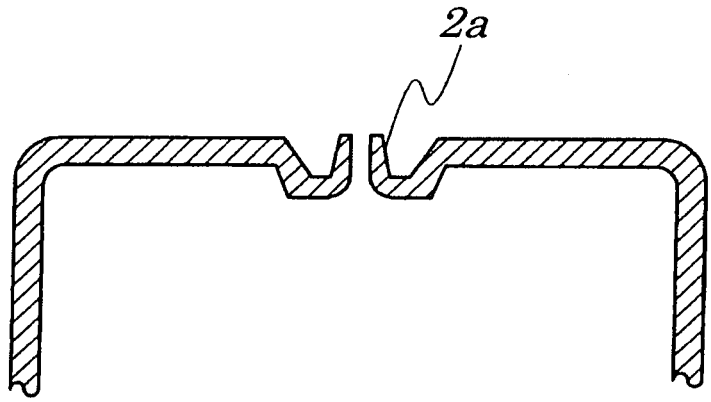
FIG. 7A (RELATED ART)
FIGS. 7A and 7B are cross-sectional views explaining a conventional structure of a molded resin cover of FIGS. 6A and 6B.
Figure 7B:
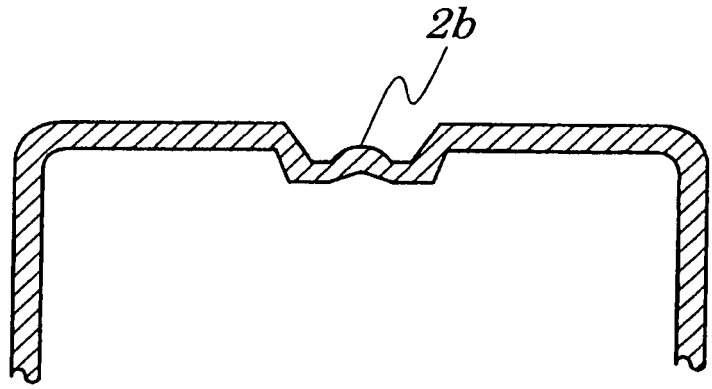
FIG. 7B (RELATED ART)

FIG. 4 is an expanded sectional view of a molded resin cover 1 made of a liquid crystal polymer 8 of the third embodiment which is applied to an electromagnetic relay shown in FIGS. 6A and 6B. It is a characteristic of the liquid crystal polymer 8 that it becomes liquid crystal phase when being in a melted state. As shown in FIG. 4, the molded resin cover 1 is of a three-layered structure including a first skin layer 9 with identical orientation of the liquid crystal formed on a surface side, a second skin layer 9 with identical orientation of the liquid crystal formed on a rear side, and a core layer 10 with random orientation of the liquid crystal formed between the first and second skin layers 9. When air ventilating openings are formed by laser beam irradiation, laser beam is not allowed fully to pass through the liquid crystal polymer 8 and allowed to pass through only the first and second skin layers 9. The first and second skin layers 9 have identical orientation of the liquid crystal and ventilation is interrupted completely. The core layer 10 has air permeability due to its random orientation of the liquid crystal and also has a function as a filter.

When laser beam is applied to the skin layers 9, by taking the relation between a diameter ϕA of a laser-beam irradiated portion 6*a* and a diameter ϕB of a laser-beam irradiated portion 6*b* shown in the first embodiment into consideration, the diameters of laser-beam irradiated portions 11*a* and 12*a* are calibrated so that the hole size of each of laser beam passing-through portions 11*b* and 12*b* is 0.1 μm to 10 μm to form laser-beam applied portions 11 and 12. Moreover, the laser beam passing-through portions 11*b* and 12*b* formed respectively on a surface and a rear of the molded resin cover 1 are not allowed to face each other and their positions are shifted so that the distances for ventilation in the core layer 10 serving as a filter can be secured at its maximum.

Thus, in the third embodiment in FIG. 4, ventilation is obtained by the minute air ventilating openings formed on the surface and rear of the molded resin cover 1 made of the liquid crystal polymer 8 and by the filtering function of the core layer 10 serving the intermediate layer. Large water contact angle of the liquid crystal polymer 8 maintains high resistance to water. Moreover, the liquid crystal polymer 8 has high heat-resistance enough to undergo lead-less soldering melting or a like, and no change in shapes of the processed air ventilating openings occurs due to heat.

Also, in the third embodiment shown in FIG. 4, since the core layer 10 existing in the intermediate position of each of the air ventilating openings functions as the filter, any coating agent can be used without limitation.

Fourth Embodiment

The fourth embodiment is described by using FIG. 4 applied in the third embodiment. That is, in the fourth embodiment, a liquid crystal polymer 8 is used as a material for a molded resin base 4 shown in FIGS. 6A and 6B. Shapes of air ventilating openings passing through only skin layers by laser beam irradiation are the same as obtained in the third embodiment. Moreover, the molded resin base 4 is coated with a sealing resin 5 from its bottom (outer surface) and laser beams are applied to portions not covered with the sealing resin 5. An electromagnetic relay of the fourth embodiment is assembled using the molded resin base 4 obtained as above and, as a result, the same effect as achieved in the third embodiment is realized. The use of the electromagnetic relay enables improved reliability of automatic parts or electrical components in particular. Besides, in other industrial fields, the present invention can be applied to an electromagnetic relay for application to measuring instruments and apparatus, which improves the reliability of contacting functions of contacts.

It is apparent that the present invention is not limited to the above embodiments but may be changed and modified without departing from the scope and spirit of the invention.

What is claimed is:

1. An electromagnetic relay comprising:

a main body comprising an electrical contact portion, an electromagnetic driving portion, and a molded resin base for mounting said electrical contact portion and said electromagnetic driving portion; wherein said main body is covered with a molded resin cover and is sealed with a sealing resin and wherein one or more through-holes are formed by applying laser beam to desired positions of said molded resin cover from an inner surface side thereof so that said through-holes each are within a size range in which no invasion of water from an outer side into the inner surface side thereof occurs and in which air permeability of said molded resin cover can be maintained through said through-holes, wherein a diameter ϕA of the through-holes at the inner surface and a diameter ϕB of the through holes at an outer side surface of said molded resin cover have a relation $$\phi A - 2 \tan \phi \cdot t = \phi B,$$

where "t" denotes a thickness of molded resin and "ϕ" denotes an angle related to focusing of the laser beam.

2. The electromagnetic relay according to claim 1, wherein said through-holes each are set within spot diameter of 0.1 μm to 10 μm on the outer surface side of said molded resin cover as the size range.

3. An electromagnetic relay comprising:

a main body comprising an electrical contact portion, an electromagnetic driving portion, and a molded resin base for mounting said electrical contact portion and said electromagnetic driving portion; wherein said main body is covered with a molded resin cover and is sealed with a sealing resin and wherein one or more through-holes are formed by applying laser beam to desired positions of said molded resin base from an inner surface side thereof, the desired positions which are not covered with said sealing resin on an outer surface side thereof so that said through-holes each are within a size range in which no invasion of water from the outer surface side into the inner surface side thereof occurs and in which air permeability of said molded resin base can be maintained through said through-holes, wherein a diameter ϕA of the through-holes at an outer side surface of said molded resin cover have a relation $$\phi A - 2 \tan \phi \cdot t = \phi B,$$

where "t" denotes a thickness of molded resin and "ϕ" denotes an angle related to focusing of the laser beam.

4. The electromagnetic relay according to claim 3, wherein said through-holes each are set within spot diameter of 0.1 μm to 10 μm on the outer surface side of said molded resin base as the size range.

5. An electromagnetic relay comprising:

a main body comprising an electrical contact portion, an electromagnetic driving portion, and a molded resin base for mounting said electrical contact portion and said electromagnetic driving portion; wherein said main body is covered with a molded resin cover and is sealed with a sealing resin and wherein said molded resin cover comprises a liquid crystal polymer having skin layers with identical orientation formed on both sides of a core layer in an intermediate position between said skin layers and wherein laser beams are applied to desired positions of said molded resin cover from both inner and outer sides thereof so that the laser beam passes through only said skin layers with said core layer being left unprocessed by the laser beams to form one or more through-holes on each of said skin layers which each are within a size range in which no invasion of water from the outer side into the inner side thereof occurs and in which air permeability of said molded resin cover can be maintained through said through-holes.

6. The electromagnetic relay according to claim 5, wherein said through-holes each are set within spot diameter of 0.1 μm to 10 μm on an outer surface side of said molded resin cover as the size range.

7. An electromagnetic relay comprising:

a main body comprising an electrical contact portion, an electromagnetic driving portion, and a molded resin base for mounting said electrical contact portion and said electromagnetic driving portion; wherein said main body is covered with a molded resin cover and is sealed with a sealing resin and wherein said molded resin base comprises a liquid crystal polymer having skin layers with identical orientation formed on both sides of a core layer in an intermediate position between said skin layers and wherein laser beams are applied to desired positions of said molded resin base from both inner and outer sides thereof, the desired positions which are not covered with said sealing resin on an outer surface side thereof, so that the laser beams pass through only said skin layers with said core layer being left unprocessed by the laser beams to form one or more through-holes on each of said skin layers which each are within a size range in which no invasion of water from the outer side into the inner side thereof occurs and in which air permeability of said molded resin base can be maintained through said through-holes.

8. The electromagnetic relay according to claim 7, wherein said through-holes each are set within spot diameter of 0.1 μm to 10 μm on an outer surface side of said molded resin base as the size range.

* * * * *

UNITED STATES PATENT AND TRADEMARK OFFICE

CERTIFICATE OF CORRECTION

PATENT NO. : 7,538,645 B2
APPLICATION NO. : 11/668738
DATED : May 26, 2009
INVENTOR(S) : Yasuhisa Nishi and Hiromitsu Ito It is certified that error appears in the above-identified patent and that said Letters Patent is hereby corrected as shown below:

Column 5, lines 36-67 to read as follows:

Figures 1A and 1B are diagrams showing an electromagnetic relay according to a first embodiment of the present invention and Fig. 1A is a perspective view of a molded resin cover 1 with its aperture portion faced upward and Fig. 1B is an expanded diagram showing portions 6 (6a, 6b) where laser-beam irradiation was performed. In the first embodiment, laser beam is applied surely from an inside of the molded resin cover 1, that is, from a face being opposite to a main body of the electromagnetic relay. Such a technology of applying laser beam is provided by, for example, Shinozaki Manufacturing Co., Ltd (Japan). In an example of forming a shape like this, a relation of a diameter $\Phi$A of the laser-beam irradiated portion 6a and a diameter $\Phi$B of the laser-beam irradiated portion 6b is shown, by an equation ~~$\Phi A - 2\sin\theta \cdot t = \Phi B$~~ $\underline{\Phi A - 2\tan = \theta \cdot t = \Phi B}$. Figure 5 is a cross-sectional view showing a relation between the diameter $\Phi$A of the laser beam irradiated portion (laser beam coming-in side) and the diameter $\Phi$B of the laser beam passing-through portion (laser beam going-out side). In the above equation, "$t$" denotes a thickness of molded resin and "θ" denotes an angle related to focusing of the laser beam. In the case of $CO_2$ laser, [[Φ]] $\underline{\theta}$ = 7° to 10°. Figure 2 is a graph showing a relation between the diameter $\Phi$A of the laser-beam irradiated portion 6a and the diameter $\Phi$B of the laser beam passing-through portion 6b. The thickness "$t$" is set to be 100μm. Based on the relation described above, the size $\Phi$B of the laser beam passing-through portion 6b is calibrated so as to be equal to an air ventilating opening size of 1μm to 10μm.

Correct Claim 1 in column 8, lines 5-26 to read as follows:

1. An electromagnetic relay comprising:

a main body comprising an electrical contact portion, an electromagnetic driving portion, and a molded resin base for mounting said electrical contact portion and said electromagnetic driving portion; wherein said main body is covered with a molded resin cover and is sealed with a sealing resin and wherein one or more through-holes are formed by applying laser beam to desired positions of said molded resin cover from an inner surface side thereof so that said through-holes each are within a size range in which no invasion of water from an outer <u>surface</u> side into the inner surface side thereof occurs and in which air permeability of said molded resin Signed and Sealed this Seventh Day of December, 2010

David J. Kappos

David J. Kappos
*Director of the United States Patent and Trademark Office* cover can be maintained through said through-holes, wherein a diameter $\Phi$A of the through-holes at the inner surface and a diameter $\Phi$B of the through holes at an outer side surface of said molded resin cover have a relation $$\Phi A - 2\tan[[\Phi]]\ \underline{\theta} \cdot t = \Phi B,$$

where "$t$" denotes a thickness of molded resin and "[[Φ]]$\underline{\theta}$" denotes an angle related to focusing of the laser beam.

Correct Claim 3 in column 8, lines 30-51 to read as follows:

3. An electromagnetic relay comprising:

a main body comprising an electrical contact portion, an electromagnetic driving portion, and a molded-resin base for mounting said electrical contact portion and said electromagnetic driving portion; wherein said main body is covered with a molded resin cover and is sealed with a sealing resin and wherein one or more through-holes are formed by applying laser beam to desired positions of said molded resin base from an inner surface side thereof, the desired positions which are not covered with said sealing resin on an outer surface side thereof so that said through-holes each are within a size range in which no invasion of water from the outer <u>surface</u> side into the inner <u>surface</u> side thereof occurs and in which air permeability of said molded resin base can be maintained through said through-holes, wherein a diameter $\Phi$A of the through-holes at <u>the inner surface and a diameter $\Phi$B of the through holes at</u> an outer side surface of said molded resin cover have a relation $$\Phi A - 2\tan[[\Phi]]\ \underline{\theta} \cdot t = \Phi B,$$

where "$t$" denotes a thickness of molded resin and "[[Φ]]θ" denotes an angle related to focusing of the laser beam.

UNITED STATES PATENT AND TRADEMARK OFFICE

CERTIFICATE OF CORRECTION

PATENT NO. : 7,538,645 B2
APPLICATION NO. : 11/668738
DATED : May 26, 2009
INVENTOR(S) : Yasuhisa Nishi and Hiromitsu Ito It is certified that error appears in the above-identified patent and that said Letters Patent is hereby corrected as shown below:

Column 5, lines 36-67 to read as follows:

Figures 1A and 1B are diagrams showing an electromagnetic relay according to a first embodiment of the present invention and Fig. 1A is a perspective view of a molded resin cover 1 with its aperture portion faced upward and Fig. 1B is an expanded diagram showing portions 6 (6a, 6b) where laser-beam irradiation was performed. In the first embodiment, laser beam is applied surely from an inside of the molded resin cover 1, that is, from a face being opposite to a main body of the electromagnetic relay. Such a technology of applying laser beam is provided by, for example, Shinozaki Manufacturing Co., Ltd (Japan). In an example of forming a shape like this, a relation of a diameter $\Phi$A of the laser-beam irradiated portion 6a and a diameter $\Phi$B of the laser-beam irradiated portion 6b is shown, by an equation $\underline{\Phi A - 2\tan\theta \bullet t = \Phi B}$.
Figure 5 is a cross-sectional view showing a relation between the diameter $\Phi$A of the laser beam irradiated portion (laser beam coming-in side) and the diameter $\Phi$B of the laser beam passing-through portion (laser beam going-out side). In the above equation, "$t$" denotes a thickness of molded resin and "θ" denotes an angle related to focusing of the laser beam. In the case of $CO_2$ laser, [[Φ]] 0 = 7° to 10°. Figure 2 is a graph showing a relation between the diameter $\Phi$A of the laser-beam irradiated portion 6a and the diameter $\Phi$B of the laser beam passing-through portion 6b. The thickness "$t$" is set to be 100μm. Based on the relation described above, the size $\Phi$B of the laser beam passing-through portion 6b is calibrated so as to be equal to an air ventilating opening size of 1μm to 10μm.

This certificate supersedes the Certificate of Correction issued December 7, 2010.

Signed and Sealed this
First Day of March, 2011

David J. Kappos

David J. Kappos
*Director of the United States Patent and Trademark Office*

Correct Claim 1 in column 8, lines 5-26 to read as follows:

1. An electromagnetic relay comprising:

a main body comprising an electrical contact portion, an electromagnetic driving portion, and a molded resin base for mounting said electrical contact portion and said electromagnetic driving portion; wherein said main body is covered with a molded resin cover and is sealed with a sealing resin and wherein one or more through-holes are formed by applying laser beam to desired positions of said molded resin cover from an inner surface side thereof so that said through-holes each are within a size range in which no invasion of water from an outer <u>surface</u> side into the inner surface side thereof occurs and in which air permeability of said molded resin cover can be maintained through said through-holes, wherein a diameter $\Phi$A of the through-holes at the inner surface and a diameter $\Phi$B of the through holes at an outer side surface of said molded resin cover have a relation $$\Phi A - 2\tan[[\Phi]]\ \underline{\theta} \bullet t = \Phi B,$$

where "$t$" denotes a thickness of molded resin and "[[Φ]]<u>θ</u>" denotes an angle related to focusing of the laser beam.

Correct Claim 3 in column 8, lines 30-51 to read as follows:

3. An electromagnetic relay comprising:

a main body comprising an electrical contact portion, an electromagnetic driving portion, and a molded-resin base for mounting said electrical contact portion and said electromagnetic driving portion; wherein said main body is covered with a molded resin cover and is sealed with a sealing resin and wherein one or more through-holes are formed by applying laser beam to desired positions of said molded resin base from an inner surface side thereof, the desired positions which are not covered with said sealing resin on an outer surface side thereof so that said through-holes each are within a size range in which no invasion of water from the outer <u>surface</u> side into the inner <u>surface</u> side thereof occurs and in which air permeability of said molded resin base can be maintained through said through-holes, wherein a diameter $\Phi$A of the through-holes at <u>the inner surface and a diameter $\Phi$B of the through holes at</u> an outer side surface of said molded resin cover have a relation $$\Phi A - 2\tan[[\Phi]]\ \underline{\theta} \bullet t = \Phi B,$$

where "$t$" denotes a thickness of molded resin and "[[Φ]]θ" denotes an angle related to focusing of the laser beam.

UNITED STATES PATENT AND TRADEMARK OFFICE

CERTIFICATE OF CORRECTION

PATENT NO. : 7,538,645 B2
APPLICATION NO. : 11/668738
DATED : May 26, 2009
INVENTOR(S) : Yasuhisa Nishi and Hiromitsu Ito It is certified that error appears in the above-identified patent and that said Letters Patent is hereby corrected as shown below:

Column 5, lines 36-67 to read as follows:

Figures 1A and 1B are diagrams showing an electromagnetic relay according to a first embodiment of the present invention and Fig. 1A is a perspective view of a molded resin cover 1 with its aperture portion faced upward and Fig. 1B is an expanded diagram showing portions 6 (6a, 6b) where laser-beam irradiation was performed. In the first embodiment, laser beam is applied surely from an inside of the molded resin cover 1, that is, from a face being opposite to a main body of the electromagnetic relay. Such a technology of applying laser beam is provided by, for example, Shinozaki Manufacturing Co., Ltd (Japan). In an example of forming a shape like this, a relation of a diameter $\Phi$A of the laser-beam irradiated portion 6a and a diameter $\Phi$B of the laser-beam irradiated portion 6b is shown, by an equation $\underline{\Phi A - 2\tan\theta \cdot t = \Phi B}$.
Figure 5 is a cross-sectional view showing a relation between the diameter $\Phi$A of the laser beam irradiated portion (laser beam coming-in side) and the diameter $\Phi$B of the laser beam passing-through portion (laser beam going-out side). In the above equation, "$t$" denotes a thickness of molded resin and "$\theta$" denotes an angle related to focusing of the laser beam. In the case of $CO_2$ laser, $\theta = 7°$ to $10°$. Figure 2 is a graph showing a relation between the diameter $\Phi$A of the laser-beam irradiated portion 6a and the diameter $\Phi$B of the laser beam passing-through portion 6b. The thickness "$t$" is set to be 100μm. Based on the relation described above, the size $\Phi$B of the laser beam passing-through portion 6b is calibrated so as to be equal to an air ventilating opening size of 1μm to 10μm.

This certificate supersedes the Certificates of Correction issued December 7, 2010 and March 1, 2011.

Signed and Sealed this
Twenty-sixth Day of April, 2011

David J. Kappos

David J. Kappos
*Director of the United States Patent and Trademark Office*

Correct Claim 1 in column 8, lines 5-26 to read as follows:

1. An electromagnetic relay comprising:

a main body comprising an electrical contact portion, an electromagnetic driving portion, and a molded resin base for mounting said electrical contact portion and said electromagnetic driving portion; wherein said main body is covered with a molded resin cover and is sealed with a sealing resin and wherein one or more through-holes are formed by applying laser beam to desired positions of said molded resin cover from an inner surface side thereof so that said through-holes each are within a size range in which no invasion of water from an outer <u>surface</u> side into the inner surface side thereof occurs and in which air permeability of said molded resin cover can be maintained through said through-holes, wherein a diameter $\Phi$A of the through-holes at the inner surface and a diameter $\Phi$B of the through holes at an outer side surface of said molded resin cover have a relation $$\Phi A - 2\tan[[\Phi]]\ \underline{\theta} \cdot t = \Phi B,$$

where "$t$" denotes a thickness of molded resin and "[[Φ]]<u>θ</u>" denotes an angle related to focusing of the laser beam.

Correct Claim 3 in column 8, lines 30-51 to read as follows:

3. An electromagnetic relay comprising:

a main body comprising an electrical contact portion, an electromagnetic driving portion, and a molded-resin base for mounting said electrical contact portion and said electromagnetic driving portion; wherein said main body is covered with a molded resin cover and is sealed with a sealing resin and wherein one or more through-holes are formed by applying laser beam to desired positions of said molded resin base from an inner surface side thereof, the desired positions which are not covered with said sealing resin on an outer surface side thereof so that said through-holes each are within a size range in which no invasion of water from the outer <u>surface</u> side into the inner <u>surface</u> side thereof occurs and in which air permeability of said molded resin base can be maintained through said through-holes, wherein a diameter $\Phi$A of the through-holes at <u>the inner surface and a diameter $\Phi$B of the through holes at</u> an outer side surface of said molded resin cover have a relation $$\Phi A - 2\tan[[\Phi]]\ \underline{\theta} \cdot t = \Phi B,$$

where "$t$" denotes a thickness of molded resin and "[[Φ]]θ" denotes an angle related to focusing of the laser beam.